United States Patent [19]

Honda

[11] 3,993,986

[45] Nov. 23, 1976

[54] DEVICE FOR RESTRICTING THE OPERATION RANGE OF CRANES

[75] Inventor: Tadayoshi Honda, Tokyo, Japan

[73] Assignee: The Shimizu Construction Co., Ltd., Tokyo, Japan

[22] Filed: Feb. 27, 1975

[21] Appl. No.: 553,548

[30] Foreign Application Priority Data

Mar. 4, 1975 Japan ..... 50-25587
Mar. 6, 1974 Japan ..... 49-26516

[52] U.S. Cl. ..... 340/267 C; 212/39 R
[51] Int. Cl.[2] ..... G08B 21/00
[58] Field of Search ..... 340/267 C; 212/39 R, 212/39 MS

[56] References Cited

UNITED STATES PATENTS

| | | | |
|---|---|---|---|
| 3,362,022 | 1/1968 | Mork et al. | 340/267 C |
| 3,549,876 | 12/1970 | Hamilton | 340/267 C |
| 3,638,212 | 1/1972 | Peter et al. | 340/267 C |
| 3,760,401 | 9/1973 | Tallon | 340/267 C |

*Primary Examiner*—David L. Trafton
*Attorney, Agent, or Firm*—Haseltine, Lake & Waters

[57] ABSTRACT

This invention relates to a device for restricting the operation of cranes within the predetermined operation allowable range, said device having an operation control board on which is mounted a reduced-scale pattern which represents the operation range of the crane at the operation site to give a sectional indication divided into allowable range operation and restricted range operation, and having discrimination means which describes the locus of motion corresponding to the top of the crane boom on said operation control board, thereby making it possible to restrict the operation of the crane based on the discrimination of the section indication.

5 Claims, 10 Drawing Figures

DEVICE FOR RESTRICTING THE OPERATION RANGE OF CRANES

SUMMARY OF THE INVENTION

This invention relates to a device for restricting the operation of the crane within a predetermined operation allowable range at the construction site where the elevation-type tower crane will be used.

At the construction site where the elevation-type cranes are being employed, and where roads or railway tracks are running within the operation radius of the long crane boom, care must be taken that the load hung from the crane or crane boom will never pass over them to assure safety. Also, where buildings are located within operation radius of the crane, that care must be taken the crane boom wll not come into contact with such buildings. Formerly operation of cranes depended on the skill of the operators alone. But nowadays, the necessity to take some measure to prevent accidents has resulted in the development of several kinds of crane-operation-range restriction devices. However, such earlier restriction devices include complex linking mechanisms and controlling by the cam plate, being designed to suit for individual cranes or designed to meet construction requirements, and are not suited for wide applications and require long periods of time for installation. Further, the construction site may sometimes require a limit switch to restrict the turning of the crane, which reduces the operational efficiency and limits the operation allowable range of the crane.

It is, therefore, an object of, the present invention to eliminate the aforesaid inconveniences. The principal object of the present invention is to provide a restriction device that assures safety of operation by automatically stopping operation of the crane when the crane boom has reached the operation restricted range for the purpose of accident preventing. Another object of the present invention is to provide a restriction device which informs the operator of the direction along which the crane boom should be retracted before the crane boom reaches the operation restricted range to assist the operator and to thereby increase operational efficiency. A further object of the present invention is to provide a restriction device which can be used at any construction sites simply by the provision of a operation control board on which is mounted a reduced-scale similar pattern of the construction site operation range for the purpose of extending the crane operation range to a maximum.

BRIEF DESCRIPTION OF THE DRAWINGS

The drawings show an embodiment of the operation range restriction device for use in cranes according to the present invention, in which.

DETAILED DESCRIPTION OF THE INVENTION

Figure 1:
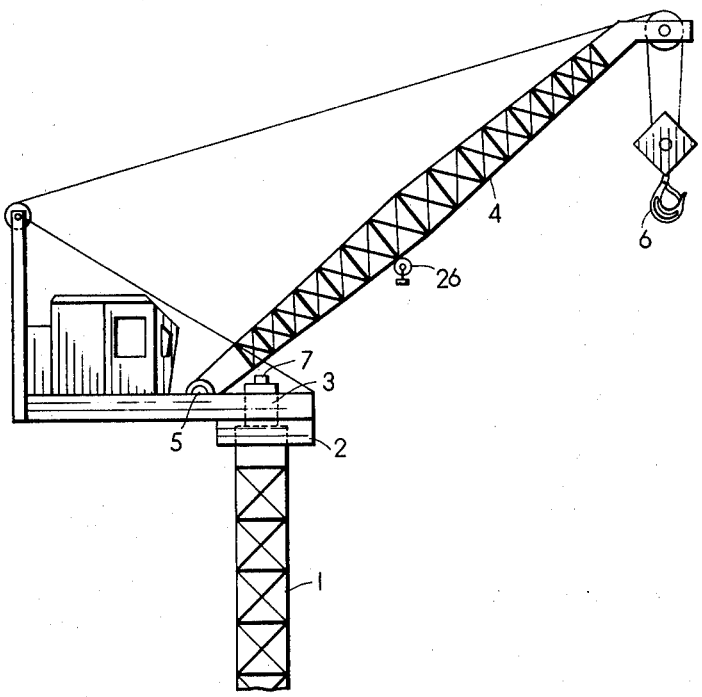
FIG. 1 is a schematic diagram of the elevation-type tower crane.
Figure 2:
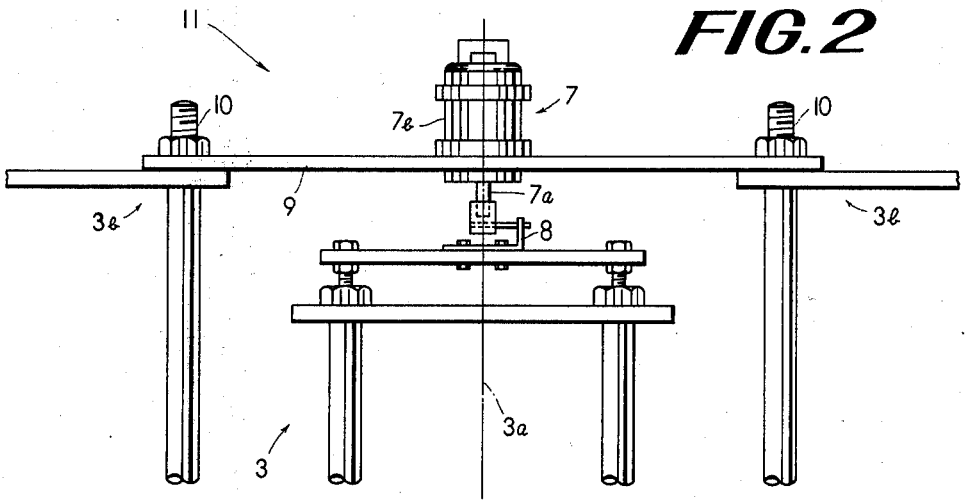
FIG. 2 is a vertical section view of the slip ring mechanism.
Figure 3A:
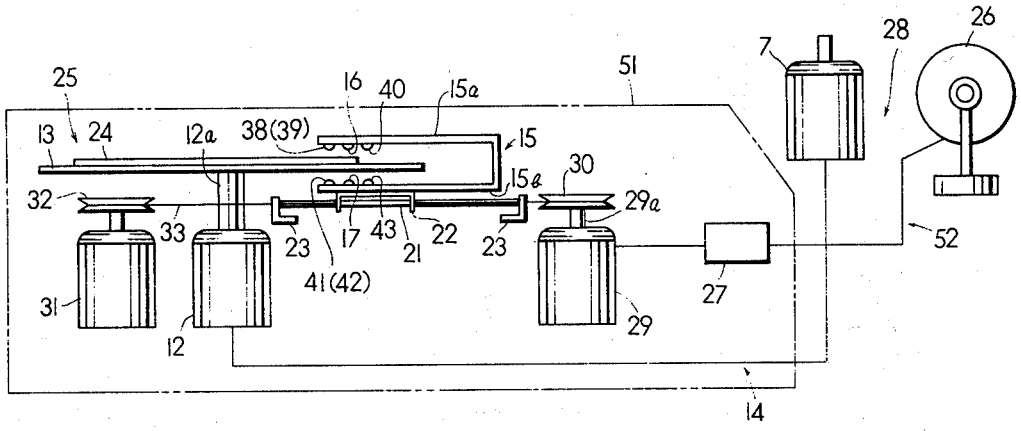
FIGS. 3(A), 3(B) are diagrams of the mechanism of the device.
Figure 3B:
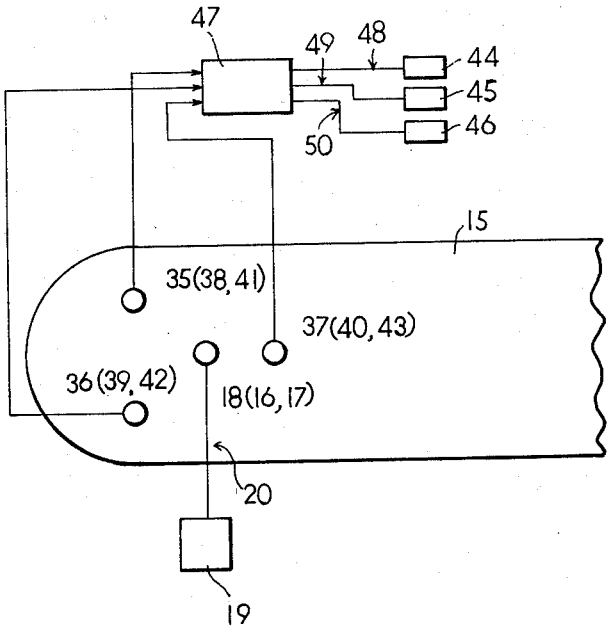
Figure 4:
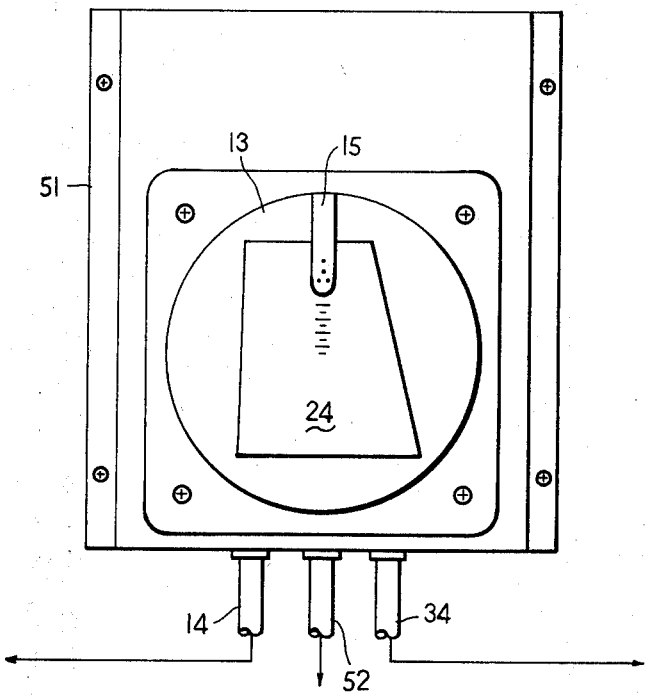
FIG. 4 is a plan view.
Figure 5A:
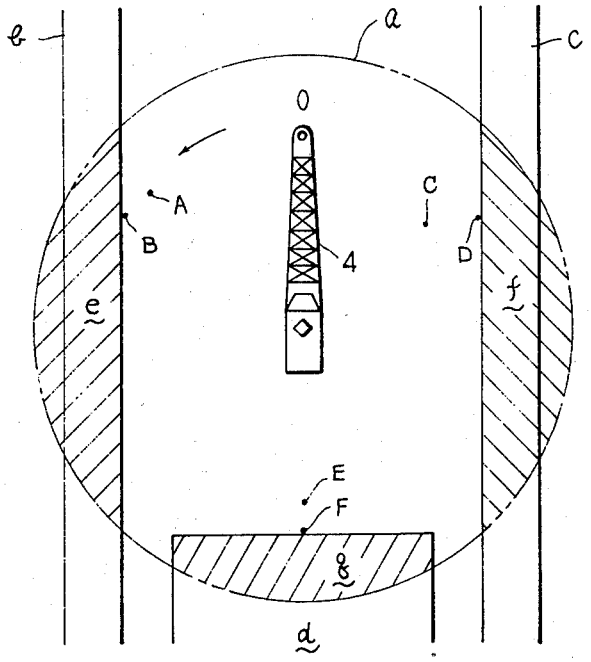
FIGS. 5(A), 5(B) are diagrams comparing the construction site and the operation control board.
Figure 5B:
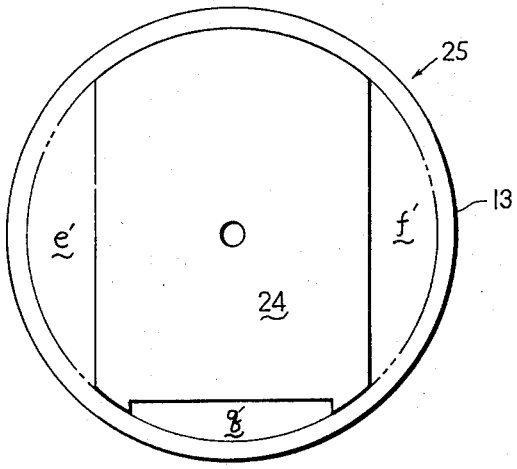

The aforesaid principal object and other objects of the present invention will become more apparent from the following embodiments illustrated in the accompanying drawings. Referring to FIGS. 1–4, designator 1 represents a mast of the elevation-type tower crane. On top of said mast 1 there is pivotally supported a revolving part 2, and at the centre of the revolving part a slip ring mechanism 3 is provided. To said revolving part 2 is pivotally connected the base part of the boom 4 by means of pivot shaft 5, maintaining freedom of elevation. Item 6 is a crane hook hung with the wire rope from the top of the boom 4. Item 7 is a selsyn motor mounted on the upper end of the slip ring mechanism 3. Rotary shaft **7*a* of the selsyn motor 7 is fastened via arm 8 to the rotary shaft 3*a* of the slip ring mechanism 3, and the rotary part 7*b* is connected via support plate 9 to the revolving part 3*b* of the slip ring mechanism 3, in order that high or low adjustment of the threaded rod 10, 10— which fastens said support plate 9, may cause the selsyn motor 7, rotary part 7*b* of the slip ring mechanism 3 and the revolving part 3*b* to rotate by the same angle in conformity on the same axial line. The slip ring mechanism 3 and the selsyn motor 7 constitute the revolving angle detector mechanism 11. Item 12 is a receiving selsyn that rotates responsive to the command of said selsyn motor 7. To the rotary shaft 12 *a* of said receiver selsyn 12 is fitted horizontally a transparent disc 13 of appropriate size. The transparent disc 13 turns by the same angle as the revolving part 2 of the crane in the direction opposite thereto. 14 is a linking passage linking selsyn motor 7 to receiving selsyn 12. 15 is a movable bed made of a shaped frame to have the transparent disc 13 sandwiched between, and advances or retreates in the radial direction of said transparent disc 13. A light-receiving element 16 and light-emitting element 17 are provided on the upper arm 15*a* and on the lower arm 15*b* of said movable bed 15 at their central top positions, respectively, thereby constituting a pair of discriminators 18 for performing automatic restriction. In other words, the light-receiving element 16 and light-emitting element 17 face each other on a straight line with the transparent disc 13 between, and said discriminator 18, being connected to a stop relay circuit 19, constitutes a discriminator mechanism 20 that automatically restricts operation of the crane boom 4. When the light is incident from the light-emitting element 17 onto the light-receiving element 16, the crane is designed to stop automatically. Item 21 is a slide rod provided underneath said movable bed 15 via a linking member 22, and item 23 is a stopper to restrict the make-break movable range of said slide rod 21. Item 24 is an opaque pattern paper laid on said transparent disc 13. Operation control board 25 is composed of said opaque pattern paper 24 and transparent disc 13. On said opaque pattern paper 24 is described a pattern of the operation allowable range on a reduced scale, and the center of rotation represents the position of the crane at the site. Moreover, the figure has been so reduced that the operation radius of the crane boom 4 will correspond to the moving range of said discriminator 18. The opaque pattern paper 24 forms the make-break making-breaking mechanism of the circuit of said discriminator mechanism 20, and interruption of light from the light-emitting element 17 to the light-receiving element 16 makes possible operation of the crane boom 4 in the range. Item 26 is a potentiometer with a sine characteristic and is located at an appropriate position of the crane boom 4. Said sine-characteristic potentiometer 26 which is connected to the drive circuit 27 constitutes an operation radius detecting mechanism 28, and converts the elevation angle of the boom 4 into the corresponding resistance variation, in order that variation of current and voltage detected by said resistance variation may cause said movable bed 15 to move by the help of said drive circuit 27 and servo motor 29. That is, the servo motor 29 moves said movable bed 15. To the rotary shaft 29***a* of said servo motor 29 is fastened a pulley 30. Across the pulley 30 and the pulley 32 which is fastened to the rotary shaft 31*a* of the linear potentiometer 31 installed below said transparent disc 13, are anchored both ends of the belt 33, and on said belt 33 is mounted said slide rod 21. In this way, the servo motor 29 which is linked to the linear potentiometer 31 establishes a servo mechanism together with said linear potentiometer 31 and drive circuit 27 which moves the movable bed 15 via slide rod 21 which is mounted on said belt 33 responsive to the command of the sine-characteristic potentiometer 26, in order that the moving amount of said discriminator 18 on the operation control board 25 always corresponds to the operation radius of the crane. Therefore, the locus of motion of the top of boom 4 on the plane of the operation site can be brought into conformity with the locus of motion of the discriminator 18 on the operation control board 25, by having the revolution of the top of boom 4 correspond to the rotation of the operation control board 25 and having the change of operation radius due to elevation operation of the boom 4 correspond to the locus of movement of the discriminator 18 that is moved by the servo mechanism utilizing said sine-characteristic potentiometer 26. This operation is effected simultaneously when the power supply is fed to the input side 34. Items 35, 36 and 37 each represent a counterclockwise revolution discriminator, clockwise revolution discriminator and elevation-operation discriminator with independent alarm discriminator 18 as a center. Each of these discriminators 35, 36 and 37 is comprised of light-receiving elements 38, 39, 40 and light-emitting elements 41, 42, 43, like the aforesaid discriminator 18 for automatical controlling. These discriminators 35, 36 and 37 are linked via a relay circuit 47 to independent counterclockwise revolution alarm 44, clockwise revolution alarm 45 and elevation alarm 46, and establish independent discrimination mechanisms 48, 49 and 50. When any one of said discriminators 35, 36 and 37 has reached the operation restricted range accompanied by the operation of the crane boom 4, the alarm corresponding thereto is produced. If the crane boom 4 is continued to move in the same direction, the discriminator 18 then causes the crane to halt its operation automatically. In the aforementioned construction, the counterclockwise revolution, clockwise revolution and elevation discriminators 35, 36 and 37 are arrayed being spaced apart appropriately with the discriminator 18 for automatical stopping as a center, in order that the alarm is produced when the crane boom 4 has reached about 3 meters before the operation restricted range. Also, with reference to the construction shown in FIG. 3(A), the parts except selsyn motor 7 and sine-characteristic potentiometer 26 are contained compactly in a container box 51 which can be installed at the operation compartment of the crane. Item 52 represents a linking passage to the sine-characteristic potentiometer 26. In the device in accordance with the present invention, the light-emitting element may be a light-emitting diode and the light-receiving element may be a cadmium sulphide photoconductor CdS. FIG. 5 (A) represents a plan view of the operation site, in which the circle *a* represents a maximum range of the locus of plane movement described by the top of the boom 4. The sign symbol *b* stands for a railway track, sign symbol *c* is a road, and symbol *d* represents a buliding which are passing through or are occupying part of the circle *a*. Hence the shaded parts *e*, *f* and *g* become range or areas on which operation of the crane is not permitted. Therefore, when preparing an opaque pattern paper 24, the portions *e'*, *f'* and *g'* that correspond to said areas *e*, *f* and *g* should be cut off, as shown in FIG. 5 (B).

Figure 6:
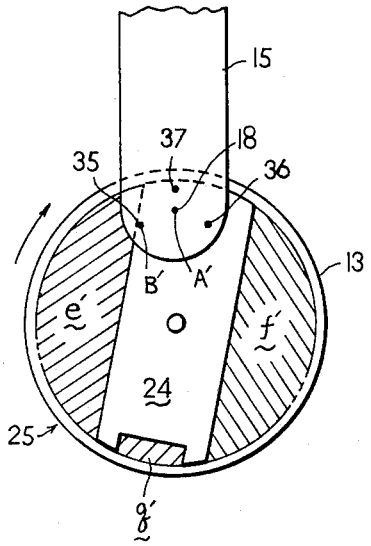
FIGS. 6(A), 6(B), 6(C) are diagrams to illustrate the operation.
Figure 6:
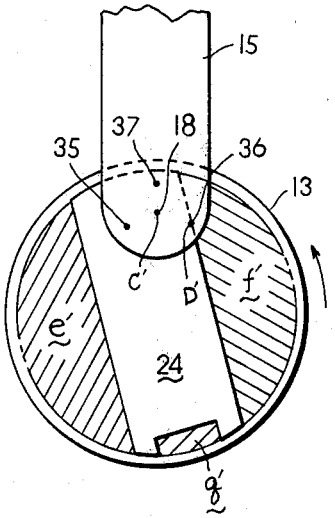
Figure 6:
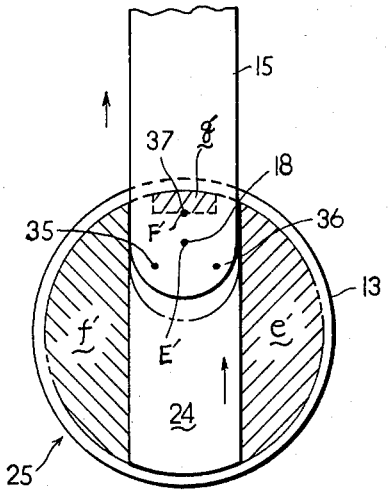

Operation of the invention is described below. If the operator operates the crane by feeding power to the input side 34 of FIG. 4, then, as an example of counterclockwise revolution, the top of the boom 4 in FIG. 5(A) moves horizontally starting from the point O toward the direction of arrow, and as it reaches the point A which is near to the operation restricted range, the operation control board 25 moves clockwise just contrary to said revolution of the crane as shown in FIG. 6 (A). The point A' on the opaque pattern paper 24 which corresponds to said point A then reaches the space in which light-receiving element 16 and light-emitting element 17 of the discriminator 18 for automatic control are facing each other. At this moment, the point B' extending beyond the edge of the opaque pattern paper 24 and corresponding to the point B of the operation restriction range *e* of FIG. 5 (A), reaches the space in which light-receiving element 38 and light-emitting element 41 of the counterclockwise revolution discriminator 35 are facing each other. Then the light incident from the light-emitting element 41 onto the light-receiving element 38 causes the counterclockwise revolution alarm 44 to be produced, letting the operator to know that the boom 4 is approaching the operation restricted range *e*. The operator can then move the boom 4 toward the operation permitted range. Further, when the top of the boom 4 which is revolved in the same direction has reached the point B within the operation restricted range *e*, then the aforesaid point B' will have been in the space in which light-receiving element 16 and light-emitting element 17 of the discriminator 18 for automatic control are facing each other. Therefore, the light which is incident from the light-emitting element 17 onto the light-receiving element 16 causes the power-supply circuit of the crane to be interrupted via the stop relay circuit 19, so that operation of the crane is stopped. As for the example of clockwise revolution of the crane, if now the crane boom 4 is revolved starting from point O to the point C near the operation restricted range *f*, then the point D' on the operation control board 25 corresponding to the point D on the operation restricted range reaches the space in which light-receiving element 39 and light-emitting element 42 of the clockwise revolution discriminator 36 are facing each other, as shown in FIG. 6 (B), and results in the production of alarm from the clockwise revolution alarm 45, like the same manner as mentioned above. Here, if now the operator operates the crane boom to elevate it, then the top will move to the point C' making it possible to revolve the crane clockwise; the alarm will be produced again at the point D'. Operation by the operator may be toward the retreating direction depending upon the direction alarm, and may enter the next operation together with the elevating operation without interruption of the power supply. The crane boom will be stopped in the same manner as the aforesaid example of counterclockwise revolution. As for the elevating operation, if now the boom 4 is tilted down so that its top reaches the point E adjacent to the operation restricted range *g*, the movable bed 15 moves in the radial direction away from the revolving center of the operation control board 25; the point F′ on the operation control board 25 corresponding to the point F in the operation restricted range *g* reaches the space in which light-receiving element 40 and light-emitting element 43 of the elevation discriminator 37 are facing each other, resulting in the production of alarm from the elevation alarm 46. Accordingly, owing to these discriminators 35, 36 and 37, the operator knows the direction in which the crane should be restored before the boom 4 reaches the operation restricted range *e*, *f*, and *g*. Even when the boom 4 has reached the operation restricted ranges *e*, *f*, and *g* due to erroneous operation by the operator, the discriminator 18 for automatic control helps interrupt the power-supply circuit of the crane; operation of the crane boom 4 can be confined completely within the predetermined operation permitted ranges. Where the device of the present invention is to be used in other operation sites, the contour of the opaque pattern paper 24 may be shaped according to the reduced-scale pattern of the operation site where operation is to take place.

As will be apparent from the foregoing construction and functions, the present invention has the following distinguishing effects:

1. When the crane boom has reached the operation restricted range, the discriminator for automatic control causes the power-supply circuit to be interrupted via the relay circuit to automatically stop operation of the crane; safe operation can be assured, preventing possible accidents.

2. Discriminator for alarm functions before the crane boom reaches the operation restricted range, letting the operator know, via an alarm mechanism, the direction in which the crane boom should be retracted and makes possible reliable and easy operation without interrupting the power supply, contributing to increased operational efficiency.

3. The device can usually be adapted for counterclockwise, clockwise and elevating movements of the crane.

4. The device can be used in any operation sites simply by providing an operation control board on which is laid a reduced-scale pattern of the operation range of the operation site, and in addition, the locus of movement of the discriminator on the operation control board which is brought in conformity with the locus of movement of the boom top at the operation site, assures maximum range of crane operation.

What is claimed is:

1. A device for restricting the operation range of cranes comprising means for detecting the revolving angle of a crane and an operation control board rotated according to the command of said detecting means in synchronism therewith, said operation control board indicating sections of operation range corresponding to the reduced-scale similar figure of the operation site, a discriminator of said section indicating advances and retreats of the revolving angle of the crane according to the command of the detecting means for the operation radius of the crane, relay circuit means for automatically controlling the crane, and alarm relay circuit means, said discriminator making and breaking said relay circuit means for automatically controlling the crane and alarm relay circuit means.

2. A device for restricting the operation range of cranes according to claim 1 including slip ring means of said crane, said means of detecting the revolving angle of the crane comprising a selsyn motor fastened to the slip ring means concentrically therewith at the upper part of said slip ring means of the crane.

3. A device for restricting the operation range of cranes according to claim 1 including a selsyn of said revolving angle, said operation control board comprising a selsyn rotating in synchronism with the command of said selsyn of said revolving angle detecting means and a transparent disc fastened to the shaft of said selsyn, the upper surface of said transparent disc being laid with an opaque pattern paper shaped to a reduced-scale similar figure of the allowable operating range on the operating site, thereby indicating sections of allowable operating range.

4. A device for restricting the operating range of cranes according to claim 1 wherein said operation radius detecting means comprises a sine-characteristic potentiometer linked to the crane boom, said sine-characteristic potentiometer being linked to a drive circuit so that change of resistance due to elevation operation of the crane boom is converted into change of current and voltage.

5. A device for restricting the operation range of cranes according to Claim 1 including a servomotor and a linear potentiometer underneath said operation control board and connected to a drive circuit of said operation radius detecting means to form a servo mechanism, said discriminator being advanced and retreated in the radial direction of the operation control board by the action of said servo mechanism so that change of operation radius of the crane boom is brought into conformity with the moving amount of said discriminator for automatic control.

* * * * *